US006300930B1

(12) United States Patent
Mori

(10) Patent No.: US 6,300,930 B1
(45) Date of Patent: Oct. 9, 2001

(54) LOW-POWER-CONSUMPTION LIQUID CRYSTAL DISPLAY DRIVER

(75) Inventor: Hisashi Mori, Kanagawa (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/224,795

(22) Filed: Jan. 4, 1999

(30) Foreign Application Priority Data

Jan. 5, 1998 (JP) ..... 10-000413

(51) Int. Cl.[7] ..... G09G 3/36
(52) U.S. Cl. ..... 345/94; 345/99
(58) Field of Search ..... 345/211, 204, 345/87, 94, 103, 98, 95, 100, 52, 99, 96

(56) References Cited

U.S. PATENT DOCUMENTS 5,463,408 * 10/1995 Mio ..... 345/52
5,528,256 6/1996 Erhart et al. .
5,734,379 * 3/1998 Natsumi et al. ..... 345/211
5,739,804 * 4/1998 Okumura et al. ..... 345/99
5,748,165 * 5/1998 Kubota et al. ..... 345/96
5,790,092 * 8/1998 Moriyama ..... 345/96
5,844,534 * 12/1998 Okumura et al. ..... 345/90
5,886,679 * 3/1999 Matsuda et al. ..... 345/96

FOREIGN PATENT DOCUMENTS 631271 12/1994 (EP) .
2326013 12/1998 (GB) .
10-133174 5/1998 (JP) .
10-339863 12/1998 (JP) .

* cited by examiner

*Primary Examiner*—Steven Saras
*Assistant Examiner*—Fritz Alphonse

(57) ABSTRACT

A liquid crystal display driver periodically changes common signal lines selectively connected to pixels of a liquid crystal display panel to active level for sequentially supplying segment signals representative of a piece of image to the selected pixels, and bypassing paths are incorporated in the liquid crystal display driver so as to transfer electric charge accumulated on a presently selected common signal line to the next common signal line to be selected, thereby reducing electric power consumption.

21 Claims, 13 Drawing Sheets

LOW-POWER-CONSUMPTION LIQUID CRYSTAL DISPLAY DRIVER

FIELD OF THE INVENTION

This invention relates to a liquid crystal display driver and, more particularly, to a liquid crystal display driver having a common line driver for sequentially driving common signal lines of a liquid crystal display panel.

DESCRIPTION OF THE RELATED ART

A typical example of the liquid crystal display driver is illustrated in FIG. 1 of the drawing. The prior art liquid crystal display driver 1 is associated with a liquid crystal display panel 2. The liquid crystal display panel 2 includes pixels P00, P01, . . . , P0n, P10, P11, . . . , P1n, . . . , Pm0, Pm1, . . . and Pmn arranged in matrix, common signal lines C0, C1, . . . , Cm respectively associated with the rows of pixels P00–P0n, P10–P1n, . . . , Pm0–Pmn and segment signal lines S0, S1, . . . , Sn respectively associated with the columns of pixels P00–Pm0, P01–Pm1, . . . , P0n–Pmn. Though not shown in FIG. 1, a thin film transistor and a piece of liquid crystal sandwiched between a pixel electrode and a part of a common electrode form in combination each of the pixels P00 to Pmn. The common signal line CO, C1 . . . or Cm is connected to the gate electrodes of the thin film transistors forming the associated row, and is sometimes called as "gate line". On the other hand, the segment signal line S0, S1, . . . or Sn is connected to the source nodes of the thin film transistors forming the associated column, and is sometimes called as "source line".

The prior art liquid crystal display driver 1 includes a common line driver 3, a segment line driver 4 and a control circuit 5. The common line driver 3 is connected to the common signal lines C0 to Cm, and sequentially supplies a common signal to the common signal lines C0 to Cm. On the other hand, the segment line driver 4 is connected to the segment signal lines S0 to Sn, and supplies segment signals representative of a part of image to be produced on a row of pixels to the segment signal lines S0 to Sn in synchronism with the common signal. While the common line driver 3 is supplying the common signal from the common signal line C0 to the common signal line Cm, the segment signals produces the image on the pixel matrix P00 to Pmn, and the time period for producing the image is called as "frame".

The control circuit 5 is connected to the common line driver 3 and the segment line driver 4, and controls the image producing operation on the pixel matrix P00 to Pmn. The control circuit 5 supplies potential signals V1/V2 and a selecting signal SEL to the common line driver 3, and the common line driver 3 generates the common signal Sc0/Sc1/ . . . /Scm at different timings. An image carrying signal IMG representative of the image is supplied to the control circuit 5, and the control circuit 5 instructs the segment line driver 4 to regulate each of the segment signals to an appropriate potential level.

FIG. 2 illustrates the common line driver 3. The common line driver 3 comprises analog switching units SW0, SW1, . . . and SWm, and each of the analog switching units SW0 to SWm is implemented by a pair of analog switches ALG1/ALG2. The potential signal V1 and the other potential signal V2 are supplied to the analog switches ALG1 and the other analog switches ALG2, respectively. The pairs of analog switches ALG1/ALG2 are connected to the common signal lines C0, C1, . . . and Cm, respectively, and are controlled with the selecting signal SEL. The selecting signal SEL comprises selecting sub-signals SEL0, SEL1, . . . and SELm, and the selecting sub-signals SEL0 to SELm are respectively supplied to the analog switching units SW0 to SWm, respectively. The control circuit 5 sequentially changes the selecting sub-signals SEL0 to SELm to active high level. The selecting sub-signals SEL0 to SELm are directly supplied to the analog switches ALG1, and the other analog switches ALG2 are supplied with the complementary signals thereof internally generated. For this reason, the analog switch ALG1 and the associated analog switch ALG2 complementarily turn on and off, and supplies the common signal Sc0/Sc1/ . . . /Scm to the associated common signal line C0/C1/ . . . /Cm.

The prior art common line driver 3 behaves as illustrated in FIG. 3. Frame F1 is continued from time t0 to time t3, and frame F2 is continued from time t3 to time t6. The control circuit 5 regulates the potential signal V1 and the other potential signal V2 to potential level Va and potential level Vc in the frame F1, and sequentially changes the selecting sub-signals SEL0, SEL1, . . . and SELm to active high level at time t0, time t1, . . . and time t2. While the control circuit 5 is maintaining one of the selecting sub-signals SEL0/SEL1/ . . . /SELm at the active high level, the other selecting sub-signals are maintained at inactive low level.

The selecting sub-signals SEL0, SEL1, . . . and SELm of the active high level cause the associated analog switches ALG1 to sequentially turn on, and the analog switching units SW0, SW1, . . . and SWm supply the common signal Sc0/Sc1/ . . . /Scm of the potential level Va to the associated common signal lines C0, C1, . . . and Cm at time t0, time t1, . . . and time t2. When the selecting sub-signals SEL0/SEL1/ . . . SELm stay at the inactive low level, the analog switches ALG1 is turned off, and the associated analog switches ALG2 are turned on. Thus, only one common signal line C0, C1, . . . or Cm is changed to the potential level Va, and the other common signal lines are maintained at the potential level Vc.

The control circuit 5 regulates the potential signal V1 and the other potential signal V2 to potential level Vd and potential level Vb in the next frame F2, and sequentially changes the selecting sub-signals SEL0, SEL1, . . . and SELm to the active level at time t3, time t4, . . . and time t5.

The selecting sub-signals SEL0, SEL1, . . . and SELm are changed to the active high level at time t3, time t4, . . . and time t5, and cause the analog switches ALG1 to sequentially turn on. However, the other selecting sub-signals are maintained at the inactive low level, and the associated analog switches ALG2 are turned on. For this reason, the common signal Sc0/Sc1 . . . /Scm changes the associated common signal line C0/C1/ . . . /Cm to the potential level Vd at time t3, time t4, . . . and time t5, and the other common signal lines are maintained at the potential level Vb.

In this way, the prior art common line driver 3 alternates the common signal Sc0 to Scm between the potential range Va–Vc and the potential range Vd–Vb. As a result, the common signal Sc0–Scm changes the active level between Va and Vd and the inactive level between Vc and Vb.

A problem is encountered in the prior art liquid crystal display driver 3 in electric power consumption.

SUMMARY OF THE INVENTION

It is therefore an important object of the present invention to provide a liquid crystal display driver, which consumes a small amount of electric power.

The present inventor contemplated the problem, and noticed that each of the common signal lines C0/C1/ . . . Cm was independently charged and discharged. The control circuit 5 was expected to swing the common signal lines C0/C1/ . . . Cm between the potential level Va/Vd and the potential level Vc/Vb, and consumed a large amount of electric power. The present inventor concluded that the common line driver 3 had to reuse the current discharged from the common signal line changed from the selected state to the non-selected state.

In accordance with one aspect of the present invention, there is provided a liquid crystal display driver associated with a liquid crystal display panel having a plurality of selecting lines for selectively activating pixels and a plurality of data lines for producing a piece of image on the activated pixels in each frame and comprising a control circuit sequentially changing preliminary selecting signals from an inactive level through an active level to the inactive level in each frame and a driving circuit connected between the control circuit and the plurality of selecting lines for selectively changing the plurality of selecting lines with driving signals sequentially changed to an active level and including a control signal generator defining a plurality of sub-frames respectively assigned to the plurality of selecting lines in the aforesaid each frame and generating a control signal in a first phase of each of the plurality of sub-frames and a selecting signal in a second phase of the aforesaid each of the plurality of sub-frames after the first phase and a switching array connected between the control signal generator and the plurality of selecting lines and responsive to the control signal for transferring electric charge between one of the plurality of selecting lines driven in an associated one of the plurality of sub-frames and another of the plurality of selecting lines to be driven in the next sub-frame in the first phase, and the switching array is further responsive to the selecting signal for adjusting the aforesaid another of the plurality of selecting lines to a first predetermined potential level.

BRIEF DESCRIPTION OF THE DRAWINGS

The features and advantages of the liquid crystal display panel driver will be more clearly understood from the following description taken in conjunction with the accompanying drawings in which.

DESCRIPTION OF THE PREFERRED EMBODIMENTS

First Embodiment

Figure 1:
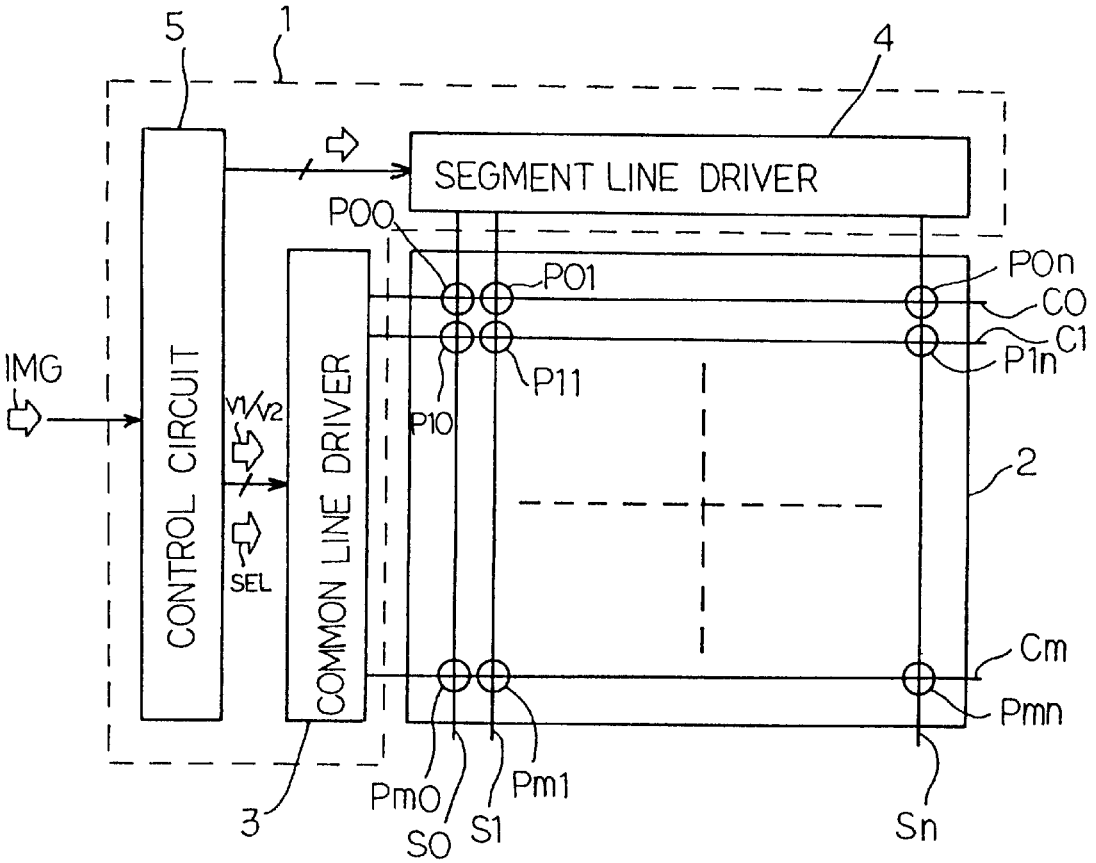
Fig. 1 PRIOR ART
FIG. 1 is a block diagram showing the arrangement between the prior art liquid crystal display panel driver and the liquid crystal display panel.
Figure 2:
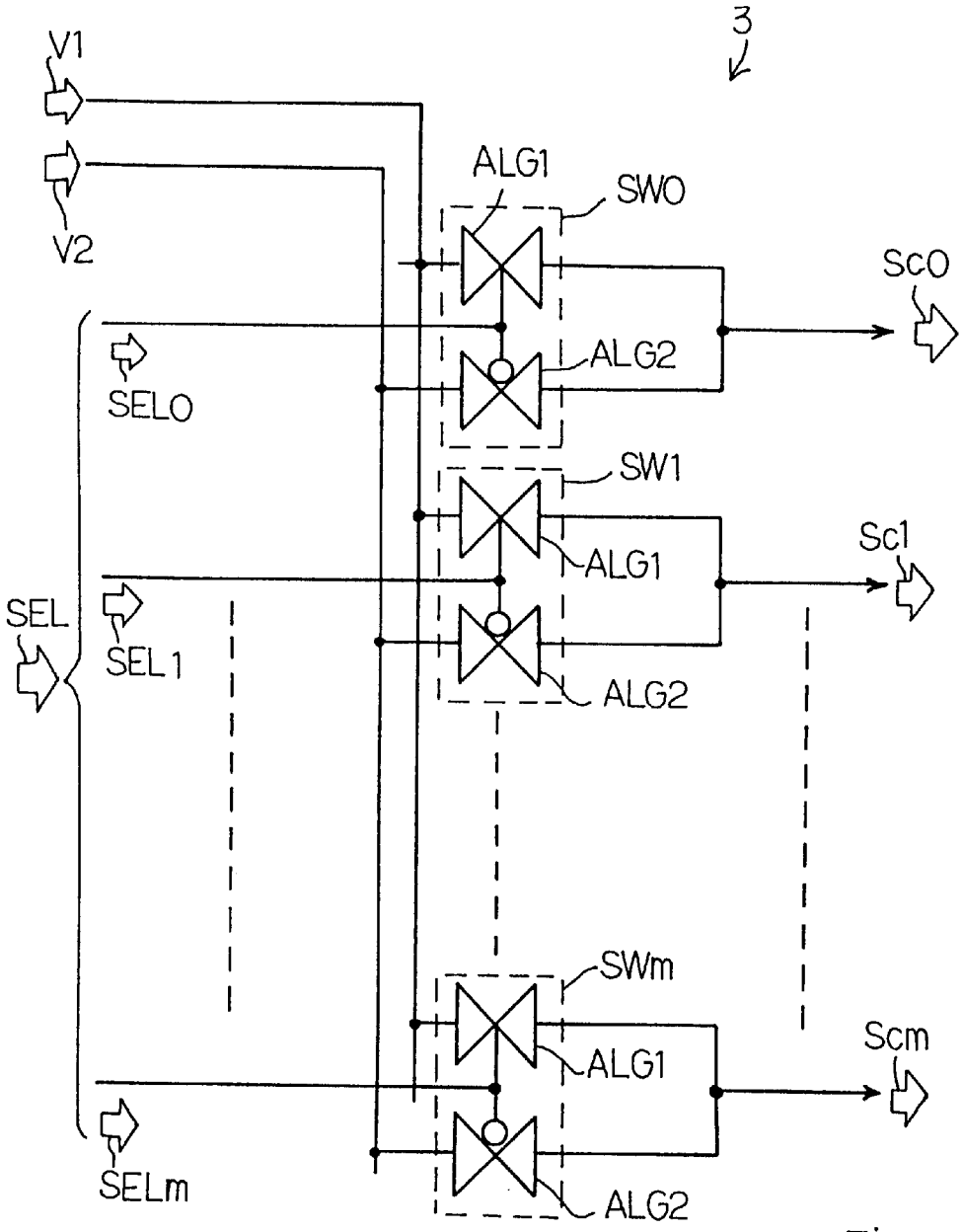
Fig. 2 PRIOR ART
FIG. 2 is a circuit diagram showing the arrangement of the prior art common line driver incorporated in the prior art liquid crystal display panel driver.
Figure 3:
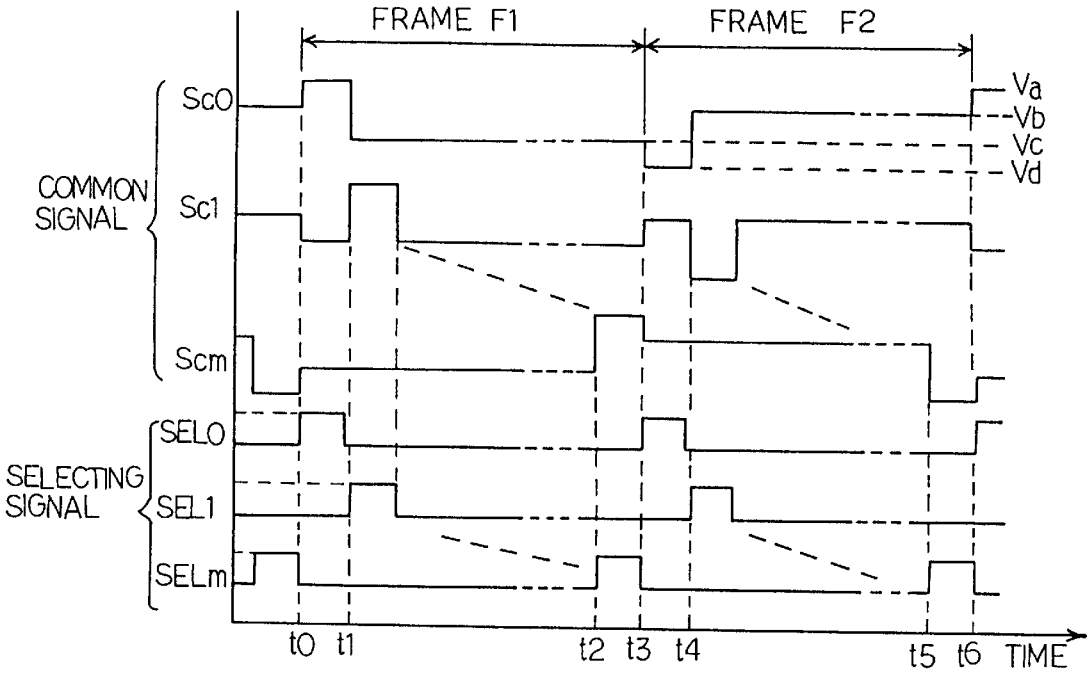
Fig. 3 PRIOR ART
FIG. 3 is a timing chart showing the circuit behavior of the prior art liquid crystal display panel driver.
Figure 4:
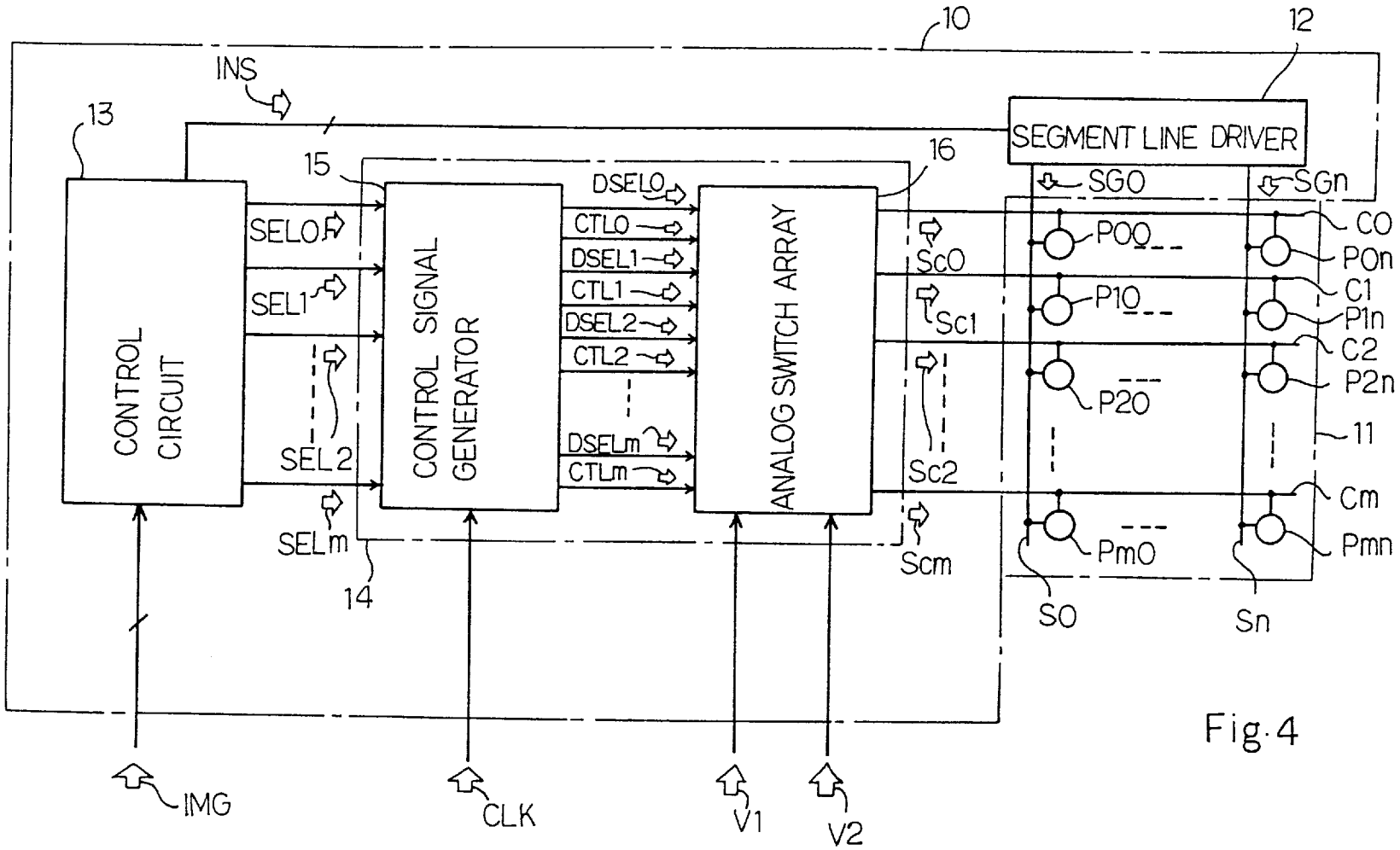
FIG. 4 is a block diagram showing the arrangement of a liquid crystal display driver according to the present invention.

Referring to FIG. 4 of the drawings, a liquid crystal display driver 10 is connected to a liquid crystal display panel 11. The liquid crystal display panel 11 is similar to the liquid crystal display panel 2, and signal lines and pixels are labeled with the same references designating corresponding signal lines and corresponding pixels of the liquid crystal display panel 2 without detailed description.

The liquid crystal display driver 10 largely comprises a segment line driver 12, a control circuit 13 and a common line driver 14. The segment line driver 12 is connected to the segment signal lines S0 to Sn, and responsive to an instruction signal INS for generating segment signals SG0 to SGn representative of a piece of image to be produced on a row of pixels P00–P0n, P10–P1n, P20–P2n, . . . or Pm0–Pmn. The segment signals SG0 to SGn are valid in a frame, and are changed from frame to frame. The segment line driver 12 is similar to that of the prior art liquid crystal display driver 1, and no further description is incorporated hereinbelow.

The control circuit 13 sequentially changes preliminary selecting sub-signals SEL0, SEL1, SEL2, . . . and SELm to the high active level, and generates the instruction signal INS in response to an image carrying signal IMG representative of the image to be produced on the pixel array P00 to Pmn. The control circuit 13 is similar to that of the prior art liquid crystal display driver 1 except the potential signals V1/V2, and no further description is incorporated hereinbelow.

The common line driver 14 includes a control signal generator 15 and an analog switch array 16. The control signal generator 15 introduces delay time into the pulse fall of each preliminary selecting signal SEL0/SEL1/ . . . /SELm and the pulse rise of the next preliminary selecting signal, and generates selecting sub-signals DSEL0 to DSELm. The control signal generator 15 further generates control signals CTL0, CTL1, CTL2, . . . and CTLm in the delay times, respectively, and, accordingly, each control signal CTL0/CTL1/ . . . /CTLm is followed by the associated control signal DSEL0/DSEL1/. . . /DSELm. The selecting sub-signals DSEL0 to DSELm and the control signals CTL0 to CTLm are supplied from the control signal generator 15 to the analog switch array 16.

The analog switch array 16 is connected to the control signal generator 15 and voltage supply lines V1/V2. The analog switch array 16 is responsive to the control signals CTL0 to CTLm and the selecting sub-signals DSEL0 to DSELm for generating a common signal Sc0/Sc1/Sc2/ . . . /Scm. The common signal Sc0/Sc1/Sc2 . . . /Scm is sequentially supplied to the common signal lines C0, C1, C2, . . . and Cm, and sequentially makes the rows of pixels P00–P0n, P10–P1n, P20–P2n, . . . and Pm0–Pmn responsive to the segment signals SG0 to SGn. The analog switch array 16 causes each common signal line C0/C1/C2/ . . . /Cm already selected to previously charge or discharge the next common signal line C1/C2/ . . . /Cm/C1 to be selected in the delay time, and, thereafter, connects the common signal line C0/C1/C2/ . . . /Cm to the voltage supply line V1. Thus, the common line driver 14 reuses the electric power, and the electric power consumption is reduced to a half of the electric power consumption of the prior art common line driver 3 by virtue of the preliminary charging/discharging operation.

Figure 5:
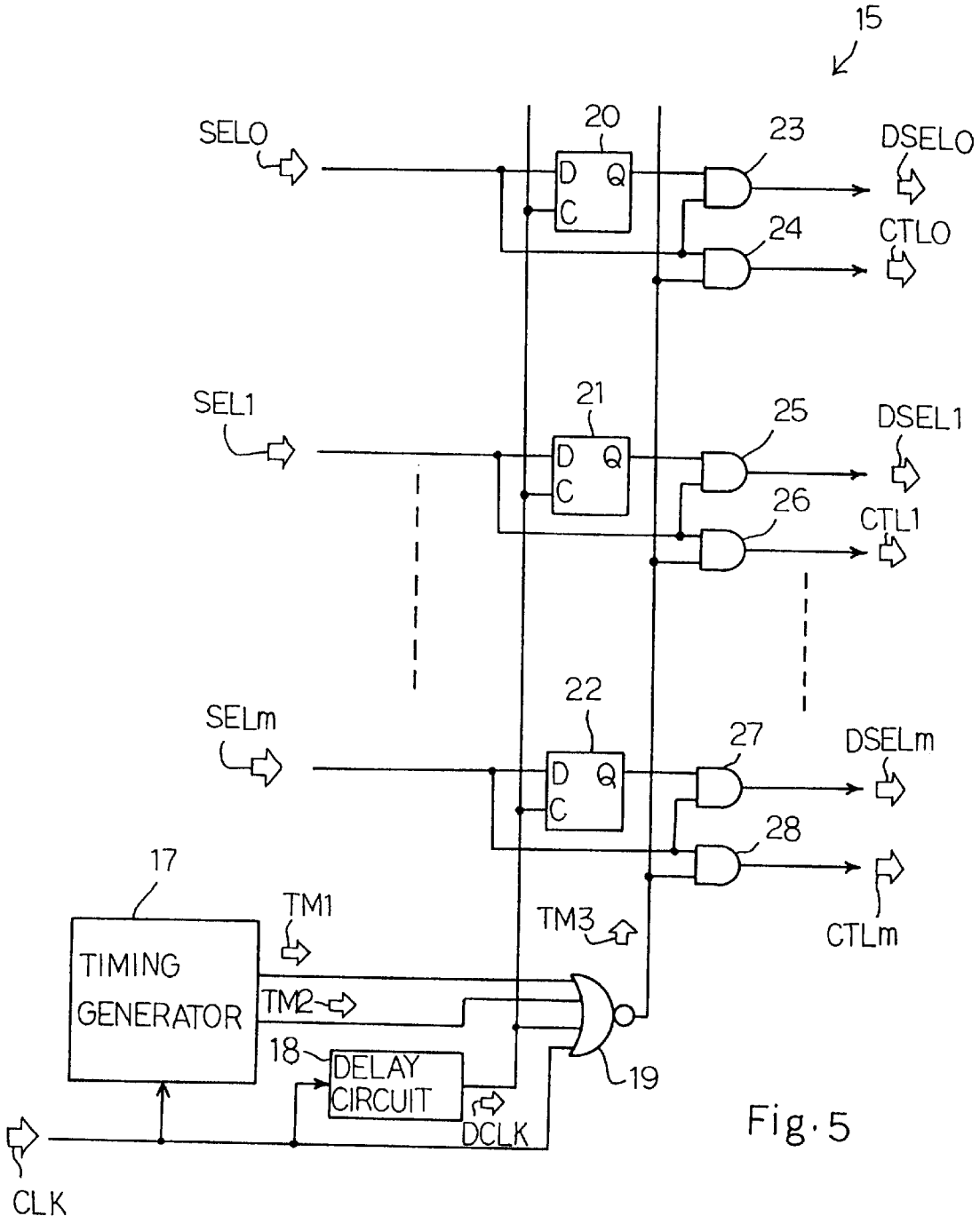
FIG. 5 is a circuit diagram showing the circuit configuration of a control signal generator incorporated in the liquid crystal display driver.

FIG. 5 illustrates the control signal generator 15. The control signal generator 15 includes a timing generator 17, a delay circuit 18, a NOR gate 19, D-type flip flop circuits 20/21/ . . . /22 and AND gates 23/24, 25/26, . . . 27/28. A clock signal CLK is supplied to an input node of the timing generator 17, and the timing generator 17 divides the clock signal CLK for generating timing signals TM1/TM2. The timing signal TM1 is twice longer in clock period than the clock signal CLK, and the timing signal TM4 is four times longer in clock period than the clock signal CLK. The clock signal CLK is further supplied to an input node of the delay circuit 18, and the delay circuit 18 produces a delayed clock signal DCLK from the clock signal CLK. The delayed clock signal DCLK at the low level is partially overlapped with the clock signal CLK at the low level. The clock signal CLK, the timing signals TM1/TM2 and the delayed clock signal DCLK are supplied to the four input nodes of the NOR gate 19, and the NOR gate 19 yields a timing signal TM3.

The preliminary selecting sub-signals SEL0–SELm are respectively supplied to the data nodes D of the D-type flip flop circuits 20–22, and the delayed clock signal DCLK is supplied to the clock nodes C of the D-type flip flop circuits 20–22. Each D-type flip flop circuit 20/21/ . . . /22 stores the voltage level of the associated preliminary selecting sub-signal SEL0/SEL1/ . . . /SELm at the pulse rise of the delayed clock signal DCLK, and changes the voltage level at the output node Q.

The preliminary selecting sub-signals SEL0–SELm are respectively supplied to the first input nodes of the AND gates 23/25/ . . . /27, and the output signals of the D-type flip flop circuits 20–22 are respectively supplied to the second input nodes of the AND gates 23/25/ . . . /27. For this reason, the when both of the associated preliminary selecting sub-signal SEL0/SEL1/ . . . /SELm and the associated output signal are in the high level, the AND gate 23/25/ . . . /27 changes the selecting sub-signal DSEL0/DSEL1/ . . . /DSELm to the high level.

The preliminary selecting sub-signals SEL0/SEL1/ . . . /SELm are respectively supplied to the first input nodes of the AND gates 24/26/ . . . /28, and the timing signal TM3 is supplied to all the second input nodes of the AND gates 24/26/ . . . /28. For this reason, while the timing signal TM3 is staying at the high level, the AND gate 24/26/ . . . /28 transfers the preliminary selecting sub-signal SEL0/SEL1/ . . . /SELm of the high level to the output node thereof so as to change the control signal CTL0/CTL1/ . . . /CTLm to the high level.

Figure 6:
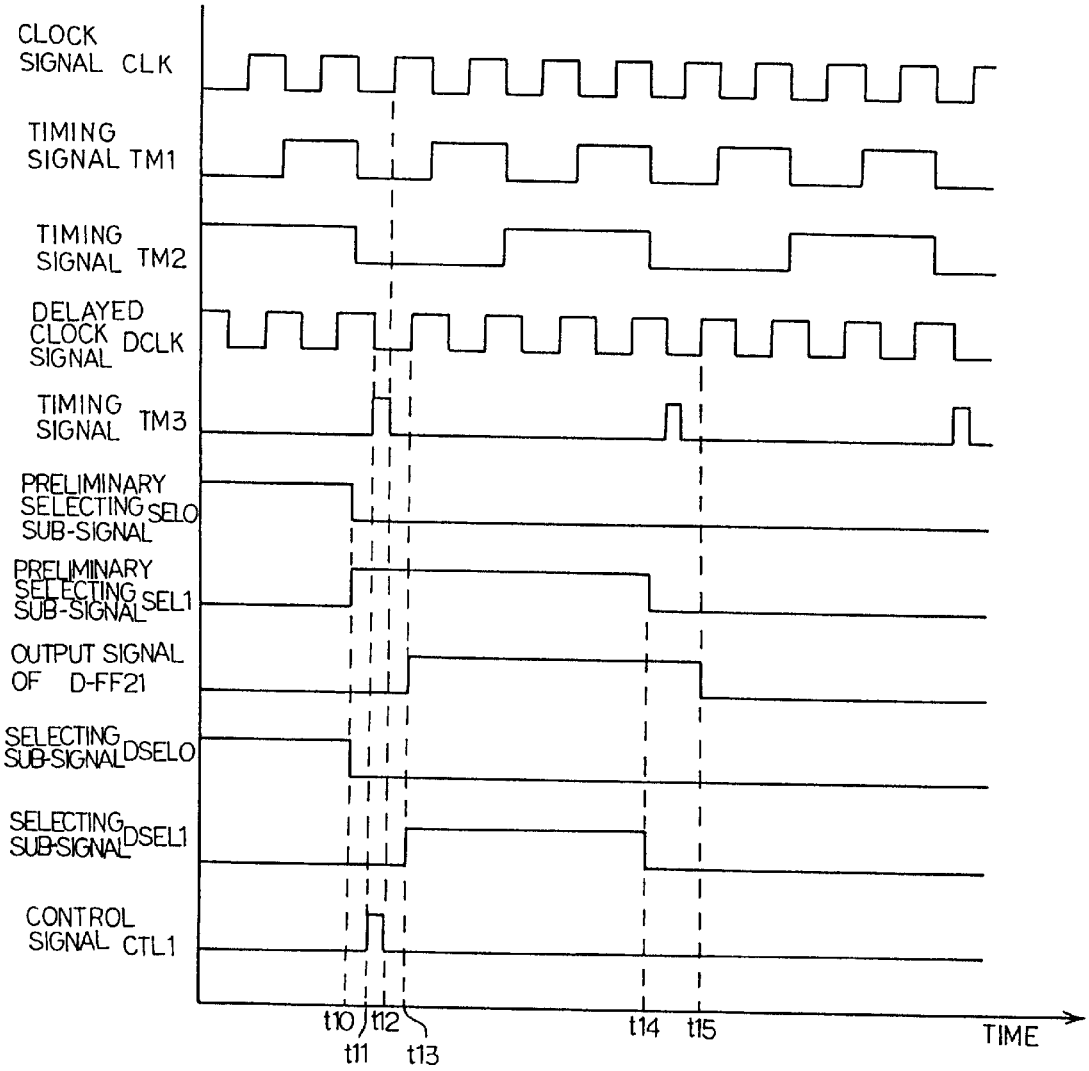
FIG. 6 is a timing chart showing the circuit behavior of the control signal generator.

FIG. 6 illustrates the circuit behavior of the control signal generator 15. Although the illustration is focused on the generation of the selecting sub-signal DSEL1 and the control signal CTL1, the other selecting sub-signals and the other control signals are generated at different timings as similar to the selecting sub-signal DSEL1 and the control signal CTL1.

The preliminary selecting sub-signal SEL0 is changed to the low level at time t10, and the next preliminary selecting sub-signal SEL1 is immediately changed to the high level. The preliminary selecting sub-signal SEL0 causes the AND gate 23 to change the selecting sub-signal DSEL0 to the low level. However, the AND gate 25 maintains the selecting sub-signal DSEL1 in the low level.

The delayed clock signal DCLK is changed to the low level at time t11. The clock signal CLK and the timing signals TM1/TM2 have been changed to the low level before time t11, and all the input nodes of the NOR gate 19 are in the low level at time t11. For this reason, the NOR gate 19 changes the timing signal TM3 to the high level, and maintains the timing signal TM3 in the high level until time t12. The clock signal CLK is changed to the high level at time t12, and the NOR gate 19 changes the timing signal TM3 to the low level at time t12.

The AND gate 26 is responsive to the timing signal TM3 at the high level, and changes the control signal CTL1 to the high level. The AND gate 26 maintains the control signal CTL1 in the high level until time t12, and changes the control signal CTL1 to the low level at time t12.

The delayed clock signal DCLK is changed to the high level at time t13 for the first time after the change of the preliminary selecting sub-signal SEL1 to the high level, and the D-type flip flop circuit 21 latches the high level of the preliminary sub-selecting signal SEL1 at the leading edge of the delayed clock signal DCLK. Then, the D-type flip flop circuit 21 changes the output node Q to the high level, and the AND gate 25 changes the selecting sub-signal DSEL1 to the high level at time t13.

The preliminary selecting sub-signal SEL1 is changed to the low level at time t14, and the delayed clock signal DCLK is changed to the high level at time t15 for the first time after the fall of the preliminary selecting sub-signal SEL1. The D-type flip flop circuit 21 latches the low level of the preliminary selecting sub-signal SEL1, and changes the output node Q to the low level.

As will be understood from the foregoing description, the control signal generator 15 firstly changes the control signal CTL0/CTL1/ . . . /CTLm to the high level, and the associated selecting sub-signal DSEL0/DSEL1/ . . . /DSELm to the high level after the recovery of the control signal.

Figure 7:
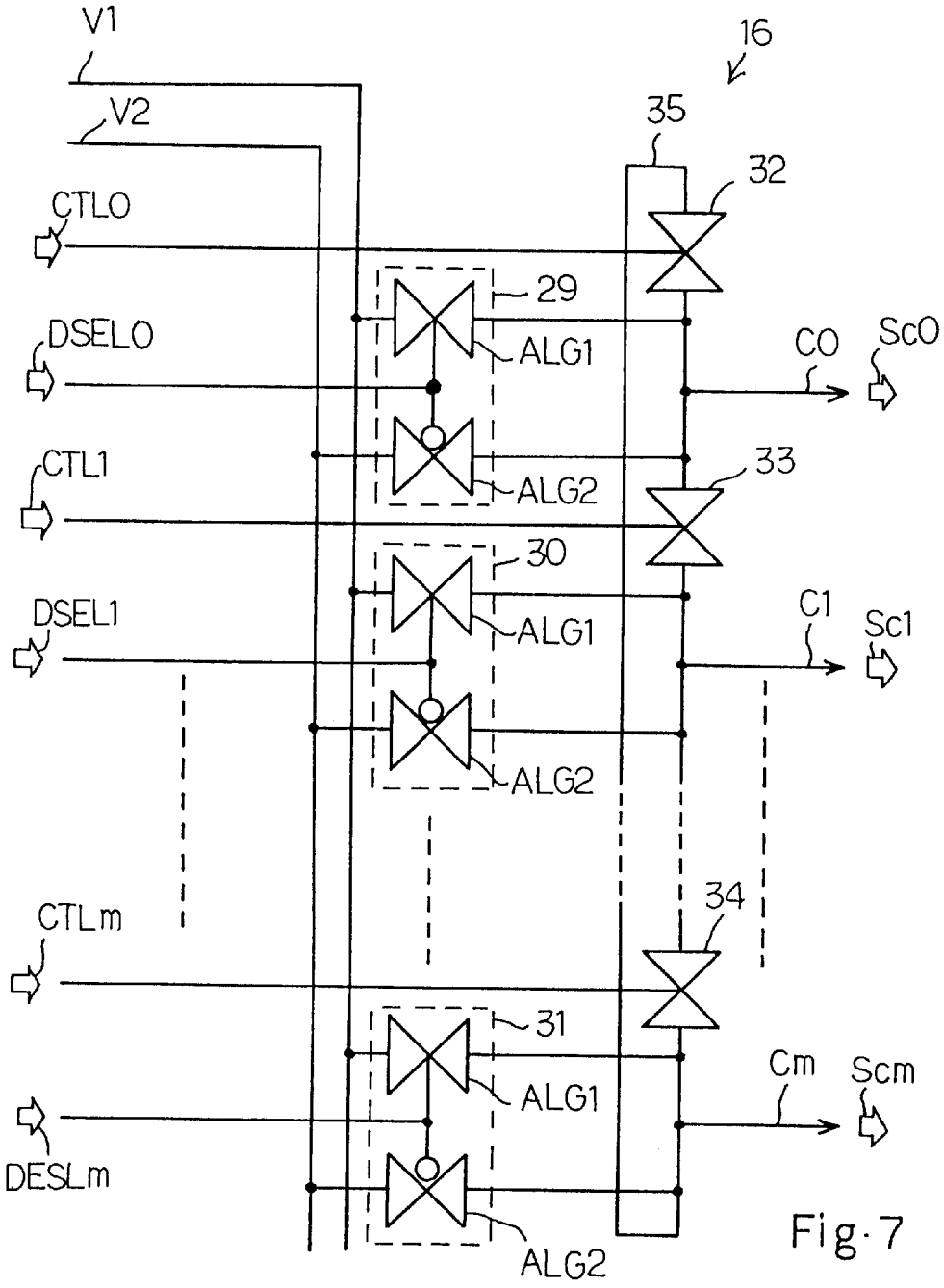
FIG. 7 is a circuit diagram showing the circuit configuration of an analog switch array incorporated in the liquid crystal display driver.

FIG. 7 illustrates the analog switch array 16. The analog switch array 16 includes analog switching units 29/30/ . . . /31, bypass switches 32/33/ . . . /34 and a current path 35. The bypass switches 32/33/ . . . /34 are implemented by analog switches, respectively. The current path 35 is looped, and the bypass switches 32/33/ . . . /34 are inserted into the current path 35 at intervals. The common signal lines C0/C1/ . . . /Cm are connected between the bypass switches 32, 33, . . . 34 and 32, and the bypass switches 32/33/ . . . /34 are respectively controlled with the control signals CTL0/CTL1/ . . . /CTLm.

The analog switching units 29/30/ . . . /31 are respectively implemented by pairs of analog switches ALG1/ALG2, and the selecting sub-signals DSEL0/DSEL1/ . . . /DSELm are supplied to the analog switching units 29/30/ . . . /31, respectively. The analog switching units 29/30/ . . . /31 invert the selecting sub-signals DSEL0/DSEL1/ . . . DSELm, and the selecting sub-signals DSEL0 to DSELm and the inverted signals are supplied to the analog switches ALG1 and the associated analog switches ALG2, respectively. However, a short delay time is introduced between the potential change of the selecting sub-signal DSEL0/DSEL1/ . . . /DSELm and the potential change of the inverted signal thereof. When the selecting sub-signal DSEL0/DSEL1/ . . . /DSELm is changed to the high level, the analog switch ALG1 turns on. On the other hand, the inverted signal of the high level causes the analog switch ALG2 to turn on.

The voltage supply line V1 is connected to the input nodes of all the analog switches ALG1, and the other voltage supply line V2 is connected to the input nodes of the other analog switches ALG2. The output nodes of the analog switching units 29/30/ . . . /31 are connected to the current path 35 between the bypass switches 32, 33, . . . , 34 and 32.

Figure 8:
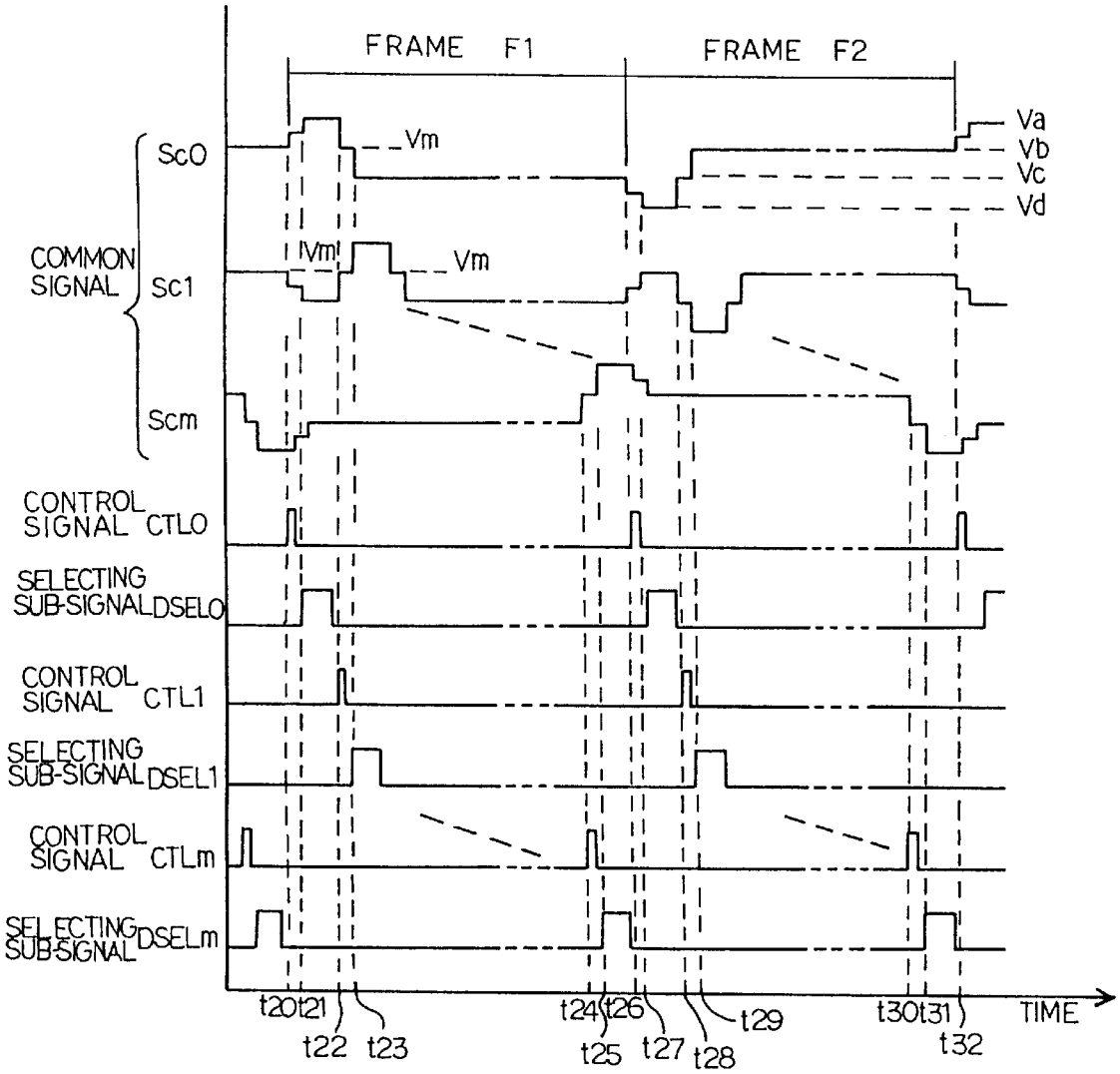
FIG. 8 is a timing chart showing the circuit behavior of the analog switch array.

FIG. 8 illustrates a sequential selection of the common signal lines C0 to Cm. Frame F1 is followed by the next frame F2, and the frames F1 and F2 are continued from time t20 to time t26 and from time t26 to time t32, respectively. While the common line driver 14 is operating in the frame F1, the voltage supply line V1 supplies potential level Va to the analog switches ALG1, and the voltage supply line V2 supplies potential level Vc to the analog switches ALG2. The potential level Vc is lower than the potential level Va. The voltage supply lines V1/V2 are changed to potential level Vd and potential level Vb, respectively, in the next frame F2. The potential level Vb is regulated between the potential level Va and the potential level Vc, and the potential level Vd is lower than the potential level Vc.

The control signals CTL0, CTL1, . . . and CTLm are sequentially changed to the active high level at time t20, time t22, . . . and time t24 in the frame F1, and cause the bypass switches 32, 33, . . . and 34 to turn on. The control signals CTL0, CTL1, . . . and CTLm are recovered to the inactive low level before time t21, time t23, . . . and time t25. While the control signal CTL0/CTL1/ . . . /CTLm is staying at the active high level, the associated bypass switch 32/33/ . . . /34 electrically connects the common signal line Cm/C0/ . . . /Cm-1 to the next common signal line C0/C1/ . . . /Cm, and the potential level on the common signal line Cm/C0/ . . . /Cm-1 is equalized to the potential level on the next common signal line C0/C1/ . . . /Cm.

After the potential equalization, the selecting sub-signals DSEL0, DSEL1, . . . and DSELm are sequentially changed to the active high level at time t21, time t23, . . . and time t25. The selecting sub-signal DSEL0/DSEL1/ . . . /DSELm at the active high level causes the analog switch AGL1 of the associated analog switching unit 29/30/ . . . /31 to turn on, and the analog switch ALG2 of the associated analog switching unit 29/30/ . . . /31 to turn off. Thus, selecting sub-signals DSEL0, DSEL1, . . . and DSELm at the active high level cause the associated analog switching units 29, 30, . . . and 31 to sequentially supply the common signal Sc0/Sc1/ . . . /Scm to the common signal lines C0, C1, . . . and Cm. The selecting sub-signals DSEL0, DSEL1, . . . and DSELm at the inactive low level causes the associated analog switching units 29, 30, . . . and 31 to electrically connect the other voltage supply line V2 to the common signal lines C0, C1, . . . and Cm.

Description is made on the transition from the common signal line C0 to the next common signal line C1. As described with reference to FIG. 6, when the control circuit 13 oppositely changes the preliminary selecting sub-signals SEL0/DSEL1 between the high level and the low level, the control signal generator 15 immediately changes the selecting sub-signal to the inactive low level. However, the control signal generator 15 keeps the selecting sub-signal DSEL1 at the inactive low level for a short while. Both selecting sub-signals DSEL0/DSEL1 are concurrently maintained at the inactive low level, and the analog switching units 29 cause the common signal lines C0, C1 to enter into high-impedance state, because the inverted signal is delayed from the selecting sub-signal DSEL1.

While the analog switching unit 29 is staying in the high-impedance state, the control signal generator 15 changes the control signal CTL1 to the active high level at time t22, and the bypass switch 33 turns on. The other bypass switches 32, . . . and 34 are turned off, and the common signal line C0 is electrically connected through the bypass switch 33 to the common signal line C1. Electric charge flows from the common signal line C0 to the common signal line C1, and the common signal lines C0 and C1 are equalized at potential level Vm (see common signal Sc0 and Sc1 between time t22 and time t23).

The control signal generator 15 changes the selecting sub-signal DSEL1 to the active high level at time t23, and the voltage supply line V1 raises the common signal line C1 to the potential level Va. On the other hand, the inverted signal of the selecting sub-signal DSEL0 causes the analog switch ALG2 of the analog switching unit 20 to turn on, and the common signal line C0 goes down to the potential level Vc.

When the control circuit changes the preliminary selecting sub-signal SEL1 and the next preliminary selecting sub-signal to the low level and the high level, respectively, the electric charge firstly flows from the common signal line C1 to the next common signal line C2, and, thereafter, the voltage supply line V1 pulls up the common signal line C2 to the potential level Va.

In the frame F2, although the common signal lines C0 to Cm are changed between the potential level Vb and the potential level Vd, the bypass switches 32 to 34 also sequentially transfer the electric charge to the next common signal lines, and the electric power consumption is reduced.

The amount of electric charge Q accumulated on the common signal line C0 to Cm is expressed by equation 1.

$$Q=C(Va-Vc) \qquad \text{Equation 1}$$

where C is the capacitance of a parasitic capacitor coupled to the common signal line. Using the potential level Vm, equation 1 is rewritten as $$Q=C(Va-Vm)+C(Vm-Vc) \qquad \text{Equation 2}$$

The potential difference (Va−Vm) is equal to the potential difference (Vm−Vc). Each of the potential differences (Va−Vm) and (Vm−Vc) is assumed to be corresponding to Qm. The amount of electric charge Q is expressed as $$Q=2Qm \qquad \text{Equation 3}$$

Solving equation 3 for Qm, $$Qm=Q/2$$

Thus, the common signal line C0 to Cm supplies half of the electric charge to be required for the next common signal line, and the electric power consumption is reduced to a half of the electric power consumption of the prior art common line driver.

As will be understood from the foregoing description, the common signal lines C0 to Cm partially charges the next common signal lines C1 to C0 through the bypass switches 32 to 34, and the common line driver 14 is improved in electric power consumption.

In the first embodiment, each sub-frame is, by way of example, corresponding to the time period between time t20 and time t22, and the first phase and the second phase of the sub-frame is continued from time t20 to time t21 and from time t21 to time t22, respectively.

Second Embodiment

Figure 9:
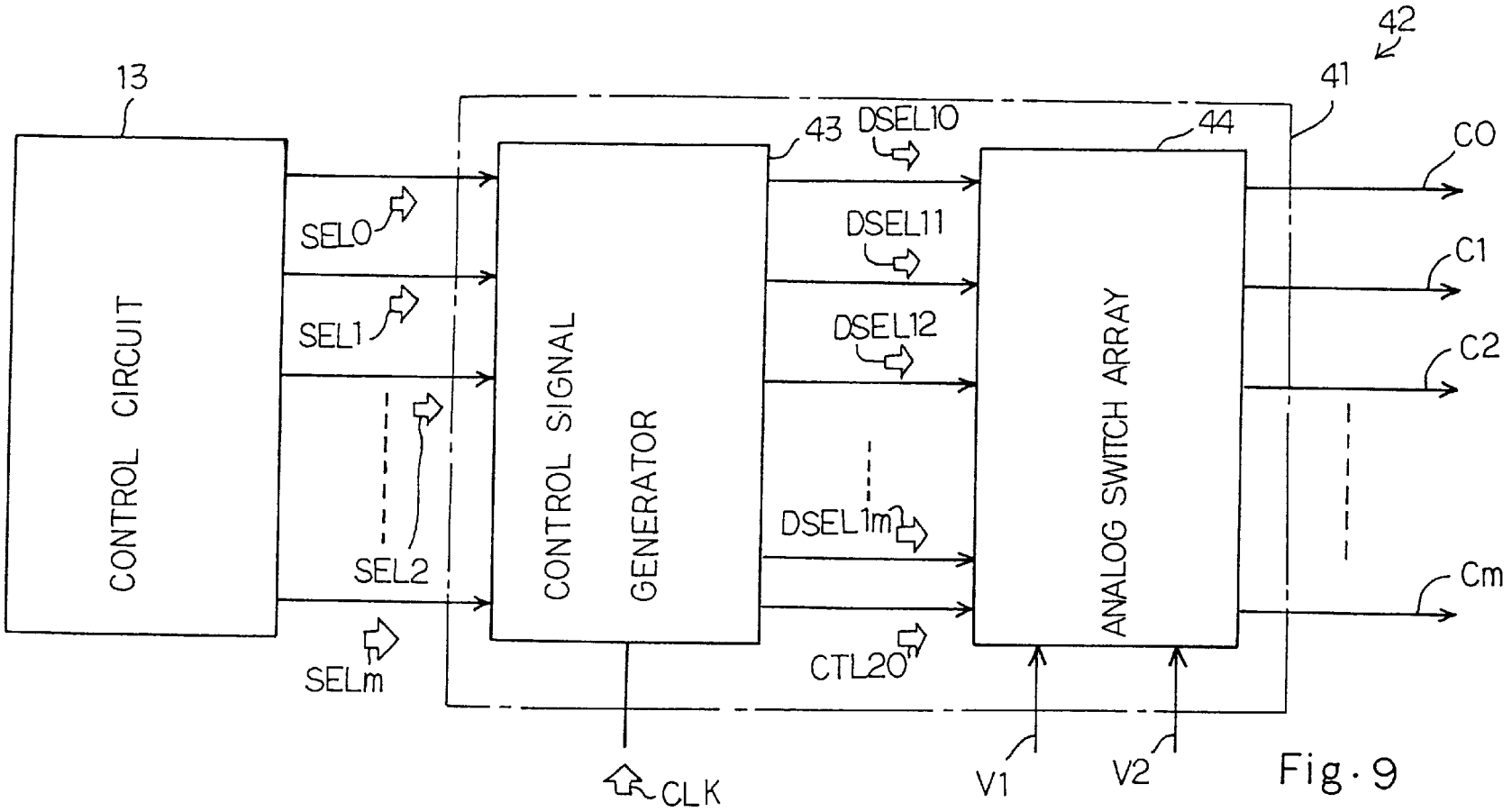
FIG. 9 is a block diagram showing the arrangement of a common line driver incorporated in another liquid crystal display driver according to the present invention.

Turning to FIG. 9 of the drawings, a common line driver 41 is connected to the common signal lines C0, C1, C2 . . . and Cm of the liquid crystal display panel 11. The common line driver 41 is incorporated in another liquid crystal display driver 42 embodying the present invention. The common line driver 41 comprises a control signal generator 43 and an analog switch array 44, and the control circuit 13 supplies the preliminary control sub-signals SEL0/SEL1/SEL2 . . . /SELm to the control signal generator 43 as similar to the first embodiment.

The preliminary selecting sub-signals SEL0–SELm and a clock signal CLK are supplied to the control signal generator 43. The control signal generator 43 produces selecting sub-signals DSEL10, DSEL11, DSEL12, . . . and DSEL1m from the preliminary selecting sub-signals SEL0/SEL1/SEL2/ . . . and SELm. The control signal generator 43 retards the pulse fall of the selecting sub-signal DSEL10/DSEL11/DSEL12/ . . . /DSEL1m from the pulse rise of the next selecting sub-signal DSEL11/DSEL12/DSEL13/ . . . /DSEL10, and makes the selecting sub-signal DSEL10/DSEL11/DSEL12/ . . . /DSEL1m partially overlapped in the high level with the next selecting sub-signal DSEL11/DSEL12/DSEL13/ . . . DSEL10.

The control signal generator 43 further produces a control signal CTL20, and the control signal CTL20 is changed to an active low level before the pulse fall of the selecting sub-signal DSEL10/DSEL11/DSEL12/ . . . /DSELm. The control signal generator 43 maintains the control signal CTL20 in the active low level for a short while, and recovers the control signal CTL20 to an inactive high level after the pulse rise of the next selecting sub-signal DSEL11/DSEL12/DSEL13/ . . . /DSEL10. The selecting sub-signals DSEL10–DSEL1m and the control signal CTL20 are supplied to the analog switch array 44.

The analog switch array 44 is responsive to the control signal CTL20 so as to flow electric charge from a selected common signal line C0/C1/C2/ . . . /Cm to the next selected common signal line C1/C2/C3/ . . . C0. After the recovery of the control signal CTL20 to the inactive high level, the analog switch array 44 connects the voltage supply line V1 to the next selected common signal line C1/C2/C3/ . . . /C0. Thus, the next selected common signal line C1/C2/C3/ . . . /C0 is firstly charged by the previously selected common signal line C0/C1/C2/ . . . /Cm, and, thereafter, the voltage supply line V1 charges the next common signal line C1/C2/C3/ . . . /C0. As a result, the electric power consumption is reduced.

Figure 10:
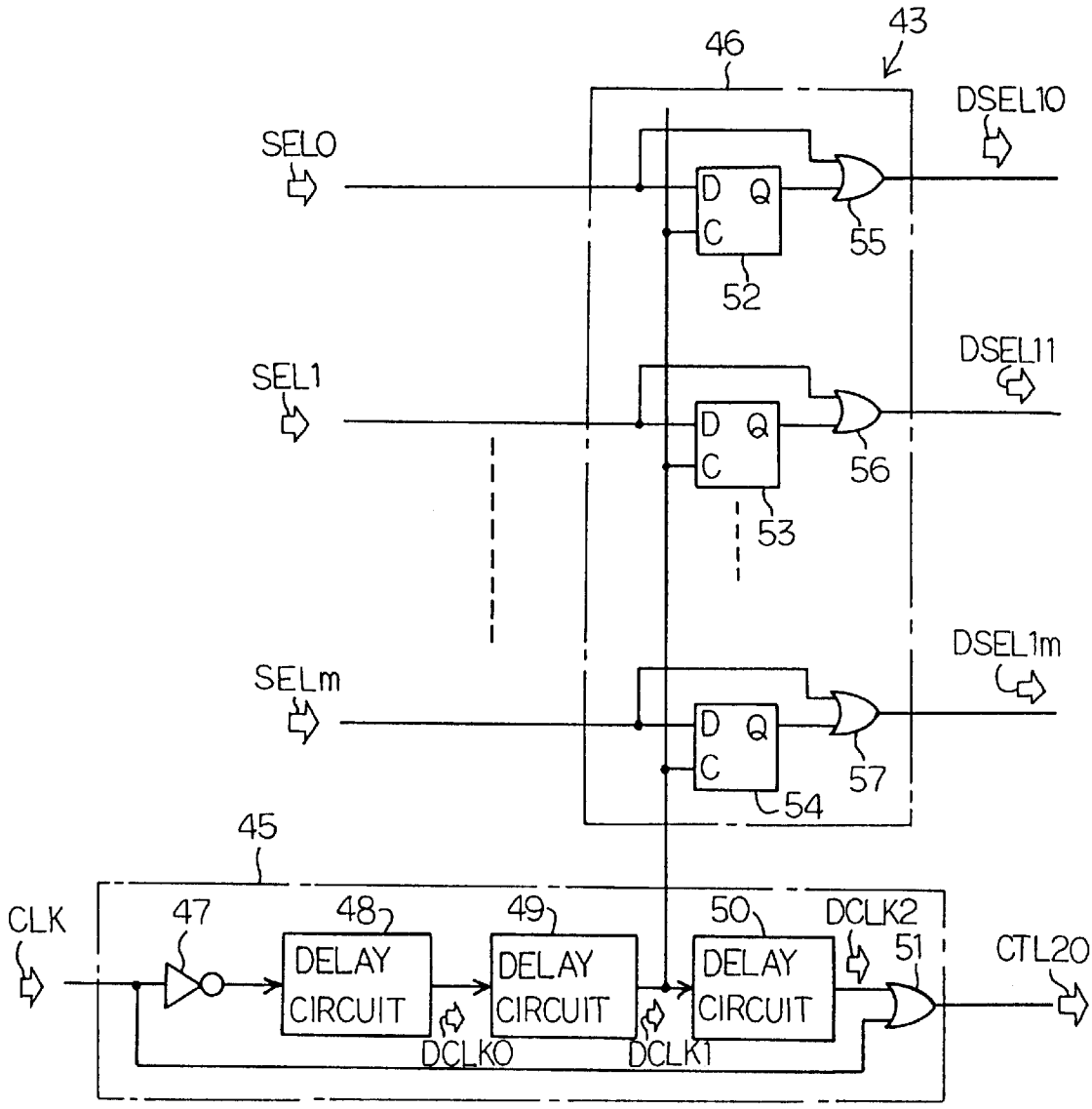
FIG. 10 is a circuit diagram showing the circuit configuration of a control signal generator incorporated in the common line driver.

FIG. 10 illustrates the control signal generator 43. The control signal generator 43 is broken down into two units 45/46. The first unit 45 produces delayed clock signals DCLK1/DCLK2 from the clock signal CLK and the control signal CTL20 from the clock signal CLK and the delayed clock signal DCLK2. On the other hand, the second unit latches the preliminary selecting sub-signals SEL0–SELm in response to the delayed clock signal DCLK1, and produces the selecting sub-signals DSEL0–DSEL1m from the preliminary selecting sub-signals SEL0–SELm and the latched signals.

Figure 11:
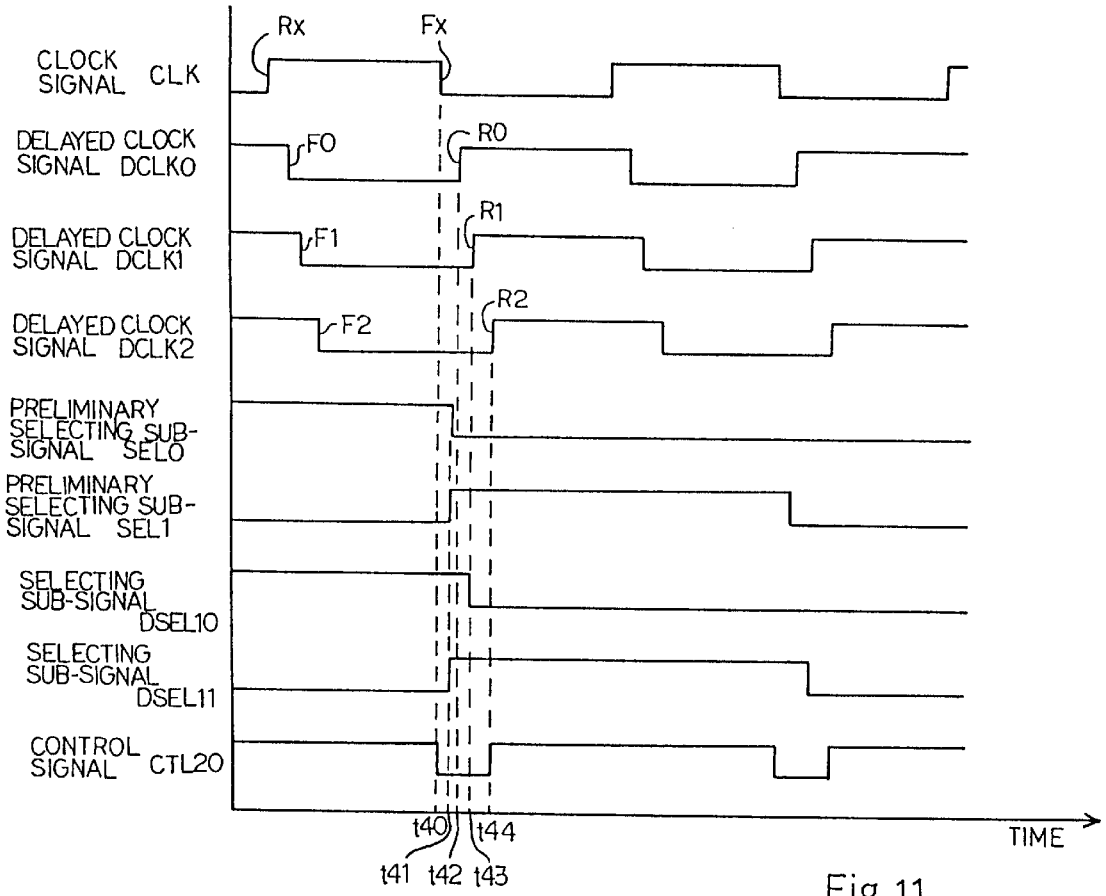
FIG. 11 is a timing chart showing the circuit behavior of the control signal generator shown in FIG. 10.

In detail, the first unit 45 includes an inverter 47 supplied with the clock signal CLK, delay circuits 48/49 connected in series to the inverter 47 for producing the delayed clock signal DCLK1, a delay circuit 50 connected to the delay circuit 49 for producing the delayed clock signal DCLK2 and an OR gate supplied with the clock signal CLK and the delayed clock signal DCLK2 for producing the control signal CTL20. As shown in FIG. 11, the delayed clock signals DCLK0, DCLK1 and DCLK2 have respective pulse falls F0/F1/F2 successively delayed from the pulse rise Rx of the clock signal CLK, and the pulse rises R0/R1/R2 are successively delayed from the pulse fall Fx. The clock signal CLK falls at time t40, and the delayed clock signals DCLK0/DCLK1/DCLK2 respectively rise at time t42, time t43 and time t44. The clock signal is ORed with the delayed clock signal DCLK2, and the first unit 45 maintains the control signal CTL20 in the active low level from time t40 to time t44.

The second unit 46 includes D-type flip flop circuits 52/53/ . . . /54 and OR gates 55/56/ . . . /57. The preliminary selecting sub-signals SEL0/SEL1/ . . . /SELm are respectively supplied to the data input nodes D of the D-type flip flop circuits 52/53/ . . . /54, and the delayed clock signal DCLK1 is supplied to the clock nodes of the D-type flip flop circuits 52/53/ . . . /54. The preliminary selecting sub-signals SEL0–SELm are respectively supplied to the first input nodes of the OR gates 55/56/ . . . /57, and the output signals of the D-type flip flop circuits 52/53/ . . . /54 are supplied to the second input nodes of the OR gates 55/56/ . . . /57, respectively. The D-type flip flop circuits 52/53/ . . . /54 latch potential levels at the data input nodes D at the pulse rise of the delayed clock signal DCLK1, and maintain the potential levels until the next pulse rise regardless of the potential change at the data input nodes D. For this reason, the D-type flip flop circuit 52/53 . . . /54 introduces delay time between the pulse fall of the associated preliminary selecting sub-signal SEL0/SEL1/ . . . /SELm and the pulse fall of the selecting sub-signal DSEL10/DSEL11/ . . . /DSEL1m.

The control circuit changes the preliminary selecting sub-signal SEL0 from the high level to the low level at time t41, and concurrently changes the next preliminary selecting sub-signal SEL1 from the low level to the high level (see FIG. 11). The preliminary selecting sub-signal SEL0 is supplied to the data input node of the D-type flip flop circuit 52 and the first input node ofthe OR gate 55, and the next preliminary selecting sub-signal SEL1 is supplied to the data input node of the D-type flip flop circuit 53 and the first input node of the OR gate 56.

The pulse rise of the preliminary selecting sub-signal SEL1 immediately affects the selecting sub-signal DSEL11 through the OR gate 56, and the next selecting sub-signal DSEL11 is changed to the high level at time t41. However, the D-type flip flop circuit 52 have latched the high level of the preliminary selecting sub-signal SEL0, and maintains the output node Q in the high level until the next pulse rise of the delayed clock signal DCLK1. The delayed clock signal DCLK1 rises at time t43, and the D-type flip flop circuit 52 latches the low level of the preliminary selecting sub-signal SEL0. The D-type flip flop circuit 52 immediately changes the output node Q to the low level, and, accordingly, the OR gate 55 changes the selecting sub-signal DSEL10 to the low level at time t43. Thus, the preliminary selecting sub-signal DSEL11 is overlapped in the high level with the preliminary selecting sub-signal DSEL10 between time t41 to time t43, and the overlap is nested in the active low level of the control signal CTL20.

Figure 12:
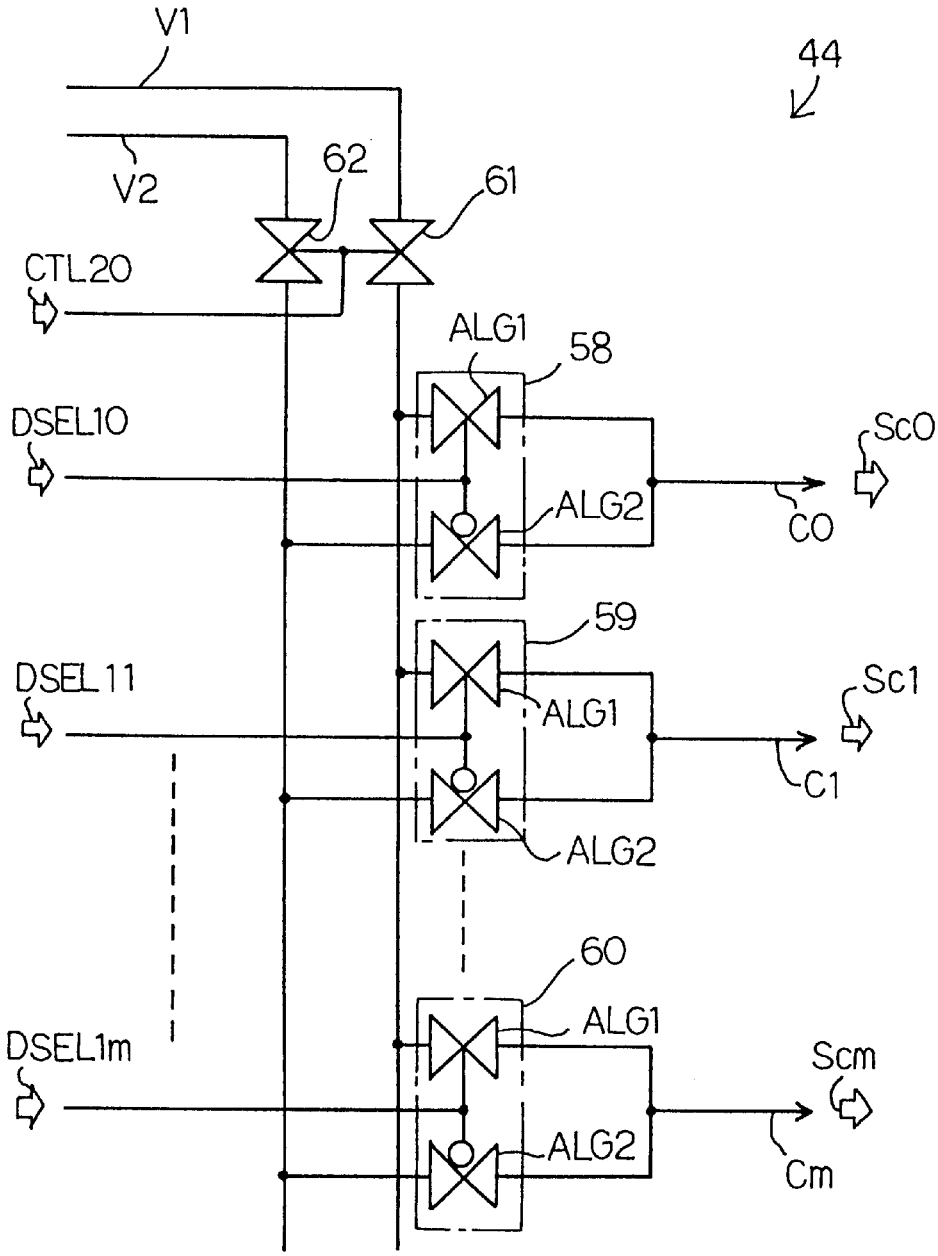
FIG. 12 is a circuit diagram showing the circuit configuration of an analog switch array incorporated in the common line driver.

FIG. 12 illustrates the analog switch array 44. The analog switch array 44 includes analog switching units 58/59/ . . . /60 and two analog switches 61/62. A parallel combination of analog switches ALG1/ALG2 forms the analog switching unit 58/59/ . . . /60. The voltage supply line V1 is connected through the analog switch 61 to the analog switches ALG1, and the other voltage supply line V2 is connected through the analog switch 62 to the analog switches ALG2. The analog switching units 58/59/ . . . /60 are respectively associated with the common signal lines C0/C1/ . . . Cm, and the analog switches ALG1/ALG2 of each unit 58/59/ . . . /60 are connected to the associated common signal line C0/C1/ . . . /Cm.

The selecting sub-signals DSEL10/DSEL11/ . . . /DSEL1m are respectively supplied to the analog switching units 58/59/ . . . /60, and the analog switching units 58/59/ . . . /60 invert the selecting sub-signals DSEL10/DSEL11/ . . . /DSEL1m. The selecting sub-signals DSEL10/DSEL11/ . . . /DSEL1m and the inverted signals thereof are supplied to the analog switches ALG1 and the analog switches ALG2, respectively. Thus, the analog switching units 58/59/ . . . /60 are selectively connect the voltage supply lines V1/V2 to the common signal lines C0/C1/ . . . /Cm depending upon the potential level of the associated selecting sub-signals DSEL10/DSEL11/ . . . /DSEL1m.

The control signal CTL20 is supplied to the analog switches 61/62. While the control signal CTL20 is staying at the inactive high level, the analog switches 61/62 are turned on, and allows the voltage supply lines V1/V2 to supply the potentials thereon to the analog switches ALG1/ALG2. On the other hand, the control signal CTL20 of the active low level renders the analog switches 61/62 off, and the analog switches ALG1/ALG2 are electrically isolated from the voltage supply lines V1/V2. While the analog switch 61 is staying in the off-state, the common signal line C0/C1/ . . . /Cm is electrically connected through the associated analog switches ALG1 to the adjacent common signal line C1/C2/ . . . /C0, because the associated selecting sub-signals are concurrently in the high level for a short while. Thereafter, the voltage supply line V1 supplies the potential through the analog switch 61 and the analog switch ALG1 to the adjacent common signal line C1/C2/ . . . /C0.

Figure 13:
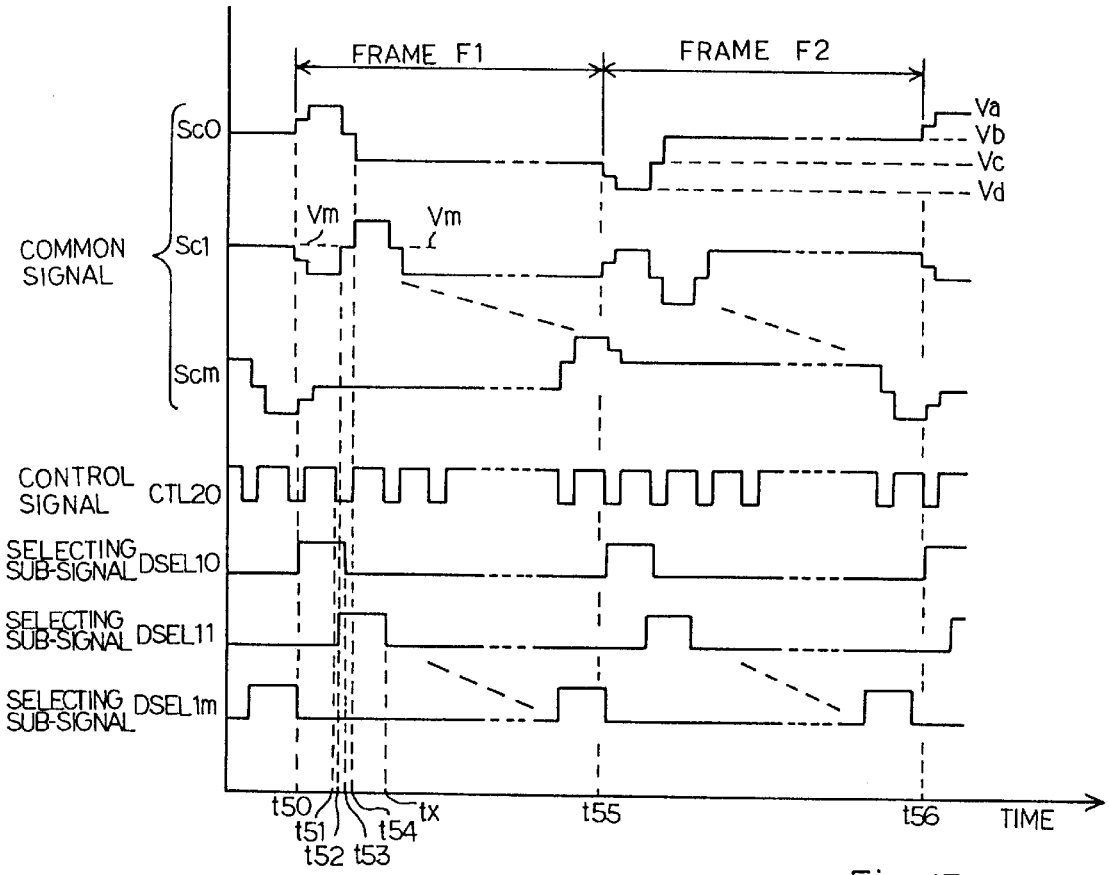
FIG. 13 is a timing chart showing the circuit behavior of the analog switch array shown in FIG. 12.

FIG. 13 illustrates the circuit behavior of the analog switch array 16 under the same conditions as the common line driver 14. Frames F1/F2 are continued from time t50 to time t55 and from time t55 to time t56, respectively. The potential levels Va/Vc are respectively supplied to the voltage supply lines V1/V2 in the frame F1, and the voltage supply lines V1/V2 are respectively changed to the potential level Vd and the potential level Vb, in the next frame F2. The common signals Sc0/Sc1/ . . . /Scm are sequentially changed to the potential level Va, and, thereafter, each common signal Sc0–Scm is decayed to the potential level Vc in the frame F1. In the next frame F2, the common signals Sc0/Sc1/ . . . /Scm are sequentially decayed to the potential level Vd, and, thereafter, each common signal Sc0–Scm rises to the potential level Vb. Thus, the common signals Sc0/Sc1/ . . . /Scm are sequentially supplied to the associated common signal lines C0/C1/ . . . /Cm. However, description is made on the transition from the common signal line C0 to the next common signal line C1 in the frame F1 for the sake of simplicity. The other transitions are analogous to the transition from the common signal line C0 to the next common signal line C1.

The clock signal CLK is changed to the high level before time t51, and the control signal CTL20 falls to the active low level at time t51. The control signal generator 43 keeps the control signal CTL20 at the active low level between time t51 and time t54. The control signal CTL20 is recovered to the inactive high level at time t54.

The preliminary selecting sub-signal SEL0 is changed to the low level at time t52, and the next preliminary selecting sub-signal SEL1 is immediately changed to the high level. The preliminary selecting sub-signal SEL1 immediately affects the selecting sub-signal DSEL11, and the selecting sub-signal DSEL11 is changed to the high level at time t52. However, the selecting sub-signal DSEL10 is maintained in the high level for a short while, and falls to the low level at time t53. Thus, both selecting sub-signals DSEL10/DSEL11 are concurrently in the high level between time t52 and time t53. The time period between time t52 and time t53 is nested in the time period from time t51 to time t54.

While the control signal CTL20 is staying in the active low level, the analog switches 61/62 are turned off, and the analog switching units 58/59/ . . . /60 are electrically isolated from the voltage supply lines V1/V2. As described hereinbefore, both analog switches ALG1 of the switching units 58/59 are turned on between time t52 and time t53, and the electric charge flows from the common signal line C0 through the analog switches ALG1 to the next common signal line C1. For this reason, the common signal Sc1 is changed to an intermediate potential level Vm until time t53.

Subsequently, the control signal CTL20 is changed to the inactive high level at time t54, and the voltage supply lines V1/V2 supplies the potentials Va and Vc through the analog switch ALG1 of the switching unit 59 and the analog switch ALG2 of the switching unit 58 to the common signal line C1 and the common signal line C0, respectively. As a result, the common signals Sc1/Sc0 are changed to the potential level Va and the potential level Vc, respectively.

The circuit components of the common line driver 41 are less than those of the common line driver 14, and achieve all the advantages of the common line driver 14.

In the second embodiment, one of the plurality of sub-frames is, by way of example, corresponding to the time period between time t51 and time t54, and the first phase and the second phase of the sub-frame are continued from time t51 to time t54 and from time t54 to the pulse fall of the selecting sub-signal DSEL11 at time tx.

As will be appreciated from the foregoing description, the particular feature of the present invention is directed to the control sequence of the common line driver 14/41 where the common line driver firstly charges a selected common signal line by using the previously selected common signal line and, thereafter, the potential line V1. The electric charge accumulated on the selected common signal line is reused for the next selected common signal line, and the electric power consumption is reduced.

Although particular embodiments of the present invention have been shown and described, it will be apparent to those skilled in the art that various changes and modifications may be made without departing from the spirit and scope of the present invention.

For example, the potential signals may be internally generated. In this instance, the external potential signals are not supplied to the liquid crystal display driver, and the clock signal CLK may be internally produced.

The liquid crystal display driver may be integrated on a single semiconductor chip. The control signal CTL20 may be supplied to the analog switch 61, only. The other analog switch 62 may be deleted from the analog switch array.

What is claimed is:

1. A liquid crystal display driver associated with a liquid crystal display panel having a plurality of selecting lines for selectively activating pixels and a plurality of data lines for producing a piece of image on the activated pixels in each frame, comprising:

a control circuit sequentially changing preliminary selecting signals from an inactive level through an active level to said inactive level in each frame; and a driving circuit connected between said control circuit and said plurality of selecting lines for selectively changing said plurality of selecting lines with driving signals sequentially changed to an active level, and including a control signal generator defining a plurality of sub-frames respectively assigned to said plurality of selecting lines in said each frame and generating a control signal in a first phase of each of said plurality of sub-frames and a selecting signal in a second phase of said each of said plurality of sub-frames after said first phase, and a switching array connected between said control signal generator and said plurality of selecting lines and responsive to said control signal for transferring electric charge between one of said plurality of selecting lines driven in an associated one of said plurality of sub-frames and another of said plurality of selecting lines to be driven in the next sub-frame in said first phase, said switching array being further responsive to said selecting signal for adjusting said another of said plurality of selecting lines to a first predetermined potential level;

a second predetermined potential level being applied to said one of said plurality of selecting lines and to said another of said plurality of selecting lines during said transferring of electric charge, said second predetermined potential level being of nonzero value.

2. The liquid crystal display driver as set forth in claim 1, in which said switching array includes a charge transfer loop connected to said plurality of selecting lines, a plurality of first switching units inserted in said charge transfer loop between the plurality of selecting lines and responsive to said control signal so as to selectively turn on, thereby electrically connecting two of said plurality of selecting lines on both sides of a selected one of said first switching units, and a plurality of second switching units connected between a first voltage supply line of said first predetermined potential level and said charge transfer loop between said plurality of first switching units and responsive to selecting sub-signals of said selecting signal so as to selectively supply said first predetermined potential level to said plurality of selecting lines in said second phase.

3. The liquid crystal display driver as set forth in claim 2, in which each of said plurality of second switching units has a first switching element connected between said first voltage supply line and said charge transfer loop and responsive to associated one of said selecting sub-signals for electrically connecting said first voltage supply line to said charge transfer loop, a means for producing an inverted signal of said associated one of said selecting sub-signals, and a second switching element connected between a second voltage supply line for propagating said second predetermined potential level different from said first predetermined potential level and said charge transfer loop and responsive to said inverted signal for electrically connecting said second voltage supply line to said charge transfer loop.

4. The liquid crystal display driver as set forth in claim 3, in which said first predetermined potential level and said second predetermined potential level define a first potential range in a frame and a second potential range different from said first potential range in another frame next to said frame.

5. The liquid crystal display driver as set forth in claim 4, in which said first potential range and said second potential range are partially overlapped with one another.

6. The liquid crystal display driver as set forth in claim 1, in which said switching array includes a first switching unit connected to a first voltage supply line of said first predetermined potential level and responsive to said control signal so as to be changed to off-state in said first phase and on-state in said second phase, and a plurality of second switching units connected between said first switching unit and said plurality of selecting lines and responsive to selecting sub-signals of said selecting signal for connecting two of said plurality of selecting lines adjacent to each other in said first phase and connecting said first voltage supply line to one of said two of said plurality of selecting lines through said first switching unit in said second phase.

7. A liquid crystal display driver associated with a liquid crystal display panel having a plurality of selecting lines for selectively activating pixels and a plurality of data lines for producing a piece of image on the activated pixels in each frame, comprising:

a control circuit sequentially changing preliminary selecting signals from an inactive level through an active level to said inactive level in each frame; and a driving circuit connected between said control circuit and said plurality of selecting lines for selectively changing said plurality of selecting lines with driving signals sequentially changed to an active level, and including a control signal generator defining a plurality of sub-frames respectively assigned to said plurality of selecting lines in said each frame and generating a control signal in a first phase of each of said plurality of sub-frames and a selecting signal in a second phase of said each of said plurality of sub-frames after said first phase, and a switching array connected between said control signal generator and said plurality of selecting lines and responsive to said control signal for transferring electric charge between one of said plurality of selecting lines driven in an associated one of said plurality of sub-frames and another of said plurality of selecting lines to be driven in the next sub-frame in said first phase, said switching array being further responsive to said selecting signal for adjusting said another of said plurality of selecting lines to a first predetermined potential level, said switching array including a charge transfer loop connected to said plurality of selecting lines, a plurality of first switching units inserted in said charge transfer loop between the plurality of selecting lines and responsive to said control signal so as to selectively turn on, thereby electrically connecting two of said plurality of selecting lines on both sides of a selected one of said first switching units, and a plurality of second switching units connected between a first voltage supply line of said first predetermined potential level and said charge transfer loop between said plurality of first switching units and responsive to selecting sub-signals of said selecting signal so as to selectively supply said first predetermined potential level to said plurality of selecting lines in said second phase, said control signal generator associated with said switching array including a control circuit responsive to a clock signal for producing a delayed clock signal and a timing signal, a plurality of first control signal generating units for introducing a delay time in signal generation from said preliminary selecting signals and selectively producing selecting sub-signals of said selecting signal in said second phase, and a plurality of second control signal generating units responsive to said timing signal for selectively generating control sub-signals of said control signal from said preliminary selecting signals in said first phase.

8. The liquid crystal display driver as set forth in claim 7, in which said control circuit includes a timing generator for producing a first frequency divided signal and a second frequency divided signal from said clock signal, a delay circuit for producing said delayed clock signal from said clock signal, and a logic gate supplied with said clock signal said, said first frequency divided signal, said second frequency divided signal and said delayed clock signal for producing said timing signal.

9. The liquid crystal display driver as set forth in claim 8, in which said logic gate carries out a NOR operation.

10. The liquid crystal display driver as set forth in claim 7, in which each of said plurality of first control signal generating units includes a D-type flip flop circuit having a data input node supplied with one of said preliminary selecting signals, a clock node supplied with said delayed clock signal and an output node, and a logic gate having a first input node connected to said output node of said D-type flip flop circuit, a second input node supplied with said one of said preliminary selecting signals and an output node for producing one of said selecting sub-signals.

11. The liquid crystal display driver as set forth in claim 10, in which said logic gate carries out an AND operation.

12. The liquid crystal display driver as set forth in claim 7, in which each of said plurality of second control signal generating units has a logic gate having a first input node supplied with said one of said preliminary selecting signals, a second node supplied with said timing signal and an output node for producing one of said control sub-signals.

13. The liquid crystal display driver as set forth in claim 12, in which said logic gate carries out an AND operation.

14. A liquid crystal display driver associated with a liquid crystal display panel having a plurality of selecting lines for selectively activating pixels and a plurality of data lines for producing a piece of image on the activated pixels in each frame, comprising:

a control circuit sequentially changing preliminary selecting signals from an inactive level through an active level to said inactive level in each frame; and a driving circuit connected between said control circuit and said plurality of selecting lines for selectively changing said plurality of selecting lines with driving signals sequentially changed to an active level, and including a control signal generator defining a plurality of sub-frames respectively assigned to said plurality of selecting lines in said each frame and generating a control signal in a first phase of each of said plurality of sub-frames and a selecting signal in a second phase of said each of said plurality of sub-frames after said first phase, and a switching array connected between said control signal generator and said plurality of selecting lines and responsive to said control signal for transferring electric charge between one of said plurality of selecting lines driven in an associated one of said plurality of sub-frames and another of said plurality of selecting lines to be driven in the next sub-frame in said first phase, said switching array being further responsive to said selecting signal for adjusting said another of said plurality of selecting lines to a first predetermined potential level, said switching array including a first switching unit connected to a first voltage supply line of said first predetermined potential level and responsive to said control signal so as to be changed to off-state in said first phase and on-state in said second phase, and a plurality of second switching units connected between said first switching unit and said plurality of selecting lines and responsive to selecting sub-signals of said selecting signal for connecting two of said plurality of selecting lines adjacent to each other in said first phase and connecting said first voltage supply line to one of said two of said plurality of selecting lines through said first switching unit in said second phase, each of said plurality of second switching units having a first switching element connected between said first voltage supply line and associated one of said plurality of selecting lines through said first switching unit and responsive to associated one of said selecting sub-signals for electrically connecting said two of said plurality of selecting lines to each other in said first phase and said first voltage supply line through said first switching unit to said associated one of said selecting sub-signals in said second phase, a means for producing an inverted signal of said associated one of said selecting sub-signals, and a second switching element connected between a second voltage supply line for propagating a second predetermined potential level different from said first predetermined potential level and said one of said plurality of selecting lines through said first switching unit and responsive to said inverted signal for electrically connecting said second voltage supply line through said first switching unit to said one of said plurality of selecting lines.

15. The liquid crystal display driver as set forth in claim 14, in which said first predetermined potential level and said second predetermined potential level define a first potential range in a frame and a second potential range different from said first potential range in another frame next to said frame.

16. The liquid crystal display driver as set forth in claim 15, in which said first potential range and said second potential range are partially overlapped with one another.

17. A liquid crystal display driver associated with a liquid crystal display panel having a plurality of selecting lines for selectively activating pixels and a plurality of data lines for producing a piece of image on the activated pixels in each frame, comprising:

a control circuit sequentially changing preliminary selecting signals from an inactive level through an active level to said inactive level in each frame; and a driving circuit connected between said control circuit and said plurality of selecting lines for selectively changing said plurality of selecting lines with driving signals sequentially changed to an active level, and including a control signal generator defining a plurality of sub-frames respectively assigned to said plurality of selecting lines in said each frame and generating a control signal in a first phase of each of said plurality of sub-frames and a selecting signal in a second phase of said each of said plurality of sub-frames after said first phase, and a switching array connected between said control signal generator and said plurality of selecting lines and responsive to said control signal for transferring electric charge between one of said plurality of selecting lines driven in an associated one of said plurality of sub-frames and another of said plurality of selecting lines to be driven in the next sub-frame in said first phase, said switching array being further responsive to said selecting signal for adjusting said another of said plurality of selecting lines to a first predetermined potential level, said switching array including a first switching unit connected to a first voltage supply line of said first predetermined potential level and responsive to said control signal so as to be changed to off-state in said first phase and on-state in said second phase, and a plurality of second switching units connected between said first switching unit and said plurality of selecting lines and responsive to selecting sub-signals of said selecting signal for connecting two of said plurality of selecting lines adjacent to each other in said first phase and connecting said first voltage supply line to one of said two of said plurality of selecting lines through said first switching unit in said second phase, said control signal generator associated with said switching array including a first control signal sub-generator for producing a delayed clock signal from a clock signal and said control signal from said delayed clock signal and said clock signal, and a second control signal sub-generator responsive to said delayed clock signal for introducing a delay time between pulse decays of said preliminary selecting signals and pulse decay of said selecting sub-signals and raising said selecting sub-signals at pulse rises of said preliminary selecting signals without substantial delay time.

18. The liquid crystal display driver as set forth in claim 17, in which said first control signal sub-generator includes an inverter supplied with said clock signal for producing an inverted clock signal, a series combination of first delay circuits connected to an output node of said inverter for producing said delayed clock signal, a second delay circuit connected to said series combination of first delay circuit, and a logic gate having a first input node connected to an output node of said second delay circuit and a second input node supplied with said clock signal for producing said control signal.

19. The liquid crystal display driver as set forth in claim 18, in which said logic gate carried out an OR operation.

20. The liquid crystal display driver as set forth in claim 17, in which said second control signal sub-generator includes a plurality of D-type flip flop circuits having respective data input node supplied with said preliminary selecting signals, respectively, respective clock nodes supplied with said delayed clock signal and respective output nodes, and a plurality of logic gates having respective first input nodes supplied with said preliminary selecting signals, respectively, and respective second input nodes connected to said output nodes of said plurality of D-type flip flop circuits, respectively, for producing said selecting sub-signals.

21. The liquid crystal display driver as set forth in claim 20, in which said plurality of logic gates carry out an OR operation.

* * * * *